US006443746B1

(12) United States Patent
Yu

(10) Patent No.: US 6,443,746 B1
(45) Date of Patent: Sep. 3, 2002

(54) MULTIPLE RECEPTACLE HAVING A WIRELESS COUPLING FEATURE

(76) Inventor: Jeff Yu, 1101 S. Winchester Blvd. Suite I-207, San Jose, CA (US) 95128

( * ) Notice: Subject to any disclaimer, the term of this patent is extended or adjusted under 35 U.S.C. 154(b) by 0 days.

(21) Appl. No.: 09/391,726

(22) Filed: Sep. 8, 1999

(51) Int. Cl.[7] ..... H01R 13/648; H01R 4/66; H01R 25/00

(52) U.S. Cl. ..... 439/107; 439/650

(58) Field of Search ..... 439/107, 188, 439/638, 535, 652, 654, 925, 650

(56) References Cited

U.S. PATENT DOCUMENTS 3,310,770 A * 3/1967 Ramsing ..... 339/14
3,327,277 A * 6/1967 Ramsing ..... 339/14
3,478,295 A * 11/1969 Gneshaber ..... 339/14
4,240,686 A * 12/1980 Kurbikoff ..... 439/107
5,350,310 A * 9/1994 Chen ..... 439/188
5,429,518 A * 7/1995 Chen ..... 439/188
5,484,309 A * 1/1996 Howard et al. ..... 439/539
5,582,522 A * 12/1996 Johnson ..... 439/214
5,788,521 A * 8/1998 Milan ..... 439/101
5,885,109 A * 3/1999 Lee et al. ..... 439/131
5,899,774 A * 5/1999 Sexton ..... 439/494
6,045,399 A * 4/2000 Yu ..... 439/214
6,113,434 A * 9/2000 Pate ..... 439/652

* cited by examiner

*Primary Examiner*—P. Austin Bradley
*Assistant Examiner*—Edwin A. León

(57) ABSTRACT

The present invention is related to an improved electrical receptacle such that more than one of such electrical receptacles are capable of being electrically coupled together without electrical wires. This feature is particularly advantageous for power adapter products such as power strips and extension boxes. A preferred embodiment includes an electrical receptacle having metal contact strips extending outward from two opposite side faces of its receptacle housing. These metal contact strips are adapted to be separately and electrically coupled to the hot, neutral and ground prongs of an inserted power plug. The receptacle is further configured so that when the metal-strip sides of two of such receptacles are disposed in close proximity of each other, the metal contact strips of the receptacles would then be physically paired. The metal contacts are paired in a manner whereby electrical connection is established and whereby the two receptacles are easily fastened. The present invention reduces or eliminates the need for wire usage in receptacle coupling, and as a result, minimizes the risks of electrical shorts and fires.

15 Claims, 3 Drawing Sheets

MULTIPLE RECEPTACLE HAVING A WIRELESS COUPLING FEATURE

TECHNICAL FIELD

The present invention relates to electrical receptacles. In particular, this invention relates to electrical receptacles capable of being electrically coupled together without electrical wires.

BACKGROUND ART

Multiple receptacles such as duplex receptacles have long been used in wall outlets, power strips and extension boxes for supplying power to electrical devices, such as refrigerators, fans, electric typewriter, and the like. As an example, FIG. 1 illustrates how a single duplex receptacle 16 is used in a typical wall outlet 30. The duplex receptacle 16 includes two receptacles 20 each having apertures to receive a plug 39. A neutral prong 41 may be received into a neutral aperture 24 of the receptacles 20. A hot prong 40 of the plug 39 may be received into a hot aperture 22 of the receptacles 20, whereas a ground prong 42 may be received into a ground aperture 26 of the receptacles 20. The duplex receptacle 16 further includes a ground screw 50 for connection via a wire to the ground of the power line. Similarly, a hot screw 51 and a neutral screw 52 of the duplex receptacle 16 connect via wires to the power source. Screws 50, 51,52 are typically used to catch and to hold the connection wires. The duplex receptacle 16 is further configured to electrically couple the hot 51, neutral 52 and ground 50 screws to the hot 40, neutral 41 and ground 42 prongs, respectively, of the plug 39 that are inserted into the receptacle apertures 22,24,26. If instead of screws 50,51,52 and that other means are used in their place, these means continue to function for the receptacle to catch and hold connection wires. The entire duplex receptacle 16 is fitted into the inside of a outlet box 28 of the wall outlet 30. It is further screwed onto the outlet box 28 through the holes in the mounting flanges 60 of the duplex receptacle 16 and through mounting holes 38 of the outlet box 28. Finally, the wall outlet 30 is operatively formed when a wall plate (not shown) is then screwed onto the outlet box 28 using a wall plate screw hole 32 of the duplex receptacle 16.

The configuration such as in this typical duplex receptacle 16 is adequate for use in the formation of wall outlets. However, it is disadvantageous for power strip and extension box applications. For instance, an elongated, generally rectangular-box shaped power strip adapter having six receptacles may have inside the housing of the power strip three duplex receptacles (without the mounting flanges 60) linearly-aligned and electrically-connected to each other via electrical wires. Namely, in order to operate the power strip properly, the neutral, hot and ground screws of one of the three duplex receptacles have to be connected to those of the other two via wires. This increases the size and costs of the power strip. In addition, it increases the risks of electrical shorts and fires because of the use of wires.

Thus, there is a continuing need for an improved electrical receptacle where the use of electrical wires for connection is greatly minimized or completely eliminated. This need is particularly keen in the case when two or more of these electrical receptacles are to be electrically coupled together in adapter products such as power strips or extension boxes.

SUMMARY OF THE INVENTION

The present invention is an electrical receptacle having a generally rectangular-box shaped housing. The housing also contains plug apertures for receiving a power plug and for supplying power to an electrical device to which the plug is connected. This receptacle has metal contact strips extending outward from two opposite side faces of the receptacle housing. These metal contact strips are adapted to be separately and electrically coupled to the hot, neutral and ground prongs of the power plug when it is plugged into the plug apertures of the receptacle. The receptacle embodiments of the present invention are further configured so that when the metal-strip sides of two of such receptacles are disposed in close proximity of each other, the metal contact strips of the receptacles would then be physically paired. The metal contacts are paired in a manner whereby electrical connection is established and whereby the two receptacles are easily fastened. One preferred way to fasten the receptacles is through soldering together each of the metal contact pairs. Another aspect of the present invention includes catch members disposed at the first ends of metal contact strips. So when paired, second ends of metal contact strips for one receptacle are caught in the catch members of the first ends of the metal contact strips of another receptacle.

Preferred embodiments of the present invention include three metal contact strips, namely hot, neutral and ground strips, each disposed in and extending through the receptacle housing. Each metal strip is configured in combination with the physical structures internal to the receptacle housing so that the hot, neutral and ground prongs of the power plug that is inserted into the receptacle apertures are electrically coupled to the hot, neutral and ground metal strips respectively.

BRIEF DESCRIPTION OF THE DRAWINGS

A better understanding of the present invention can be obtained by considering the following detailed description taken together with the accompanying drawings that illustrate preferred embodiments of the present invention in which.

DETAILED DESCRIPTION OF THE PREFERRED EMBODIMENTS

With today's advances in electrical receptacle technology, any receptacle designs generally do not require the rendering of fully detailed implementation diagrams. The definition of mechanical and electrical functionality allows those skilled in the art to design the desired electrical receptacle implementations. Accordingly, functionality will be described in detail with the accompanying drawings. Those of ordinary skill in the art, once given the following descriptions of the various aspects of the present invention will be able to implement the necessary mechanical and electrical arrangements in suitable technologies without undue experimentation.

Reference will now be made in detail to the preferred embodiments of the present invention, examples of which are illustrated in the accompanying drawings. While the invention will be described in conjunction with the preferred embodiments, it will be understood that they are not intended to limit the invention to those embodiments.

Figure 1:
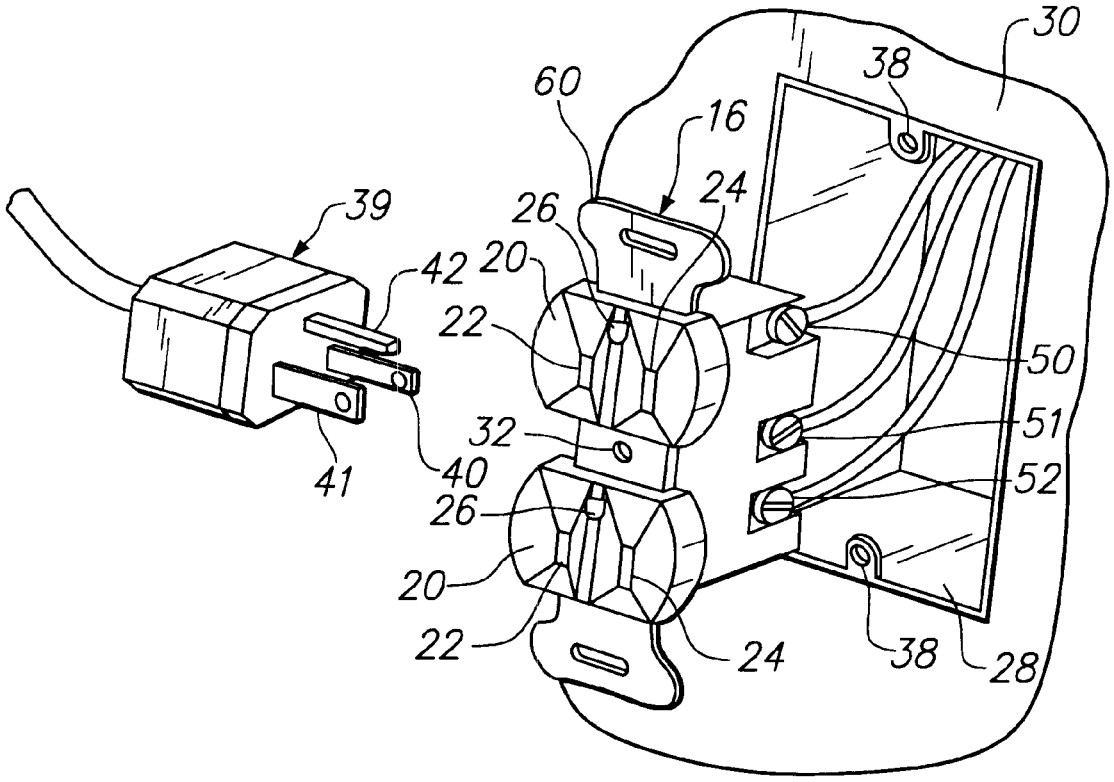
FIG. 1 is a perspective view of a typical duplex electrical receptacle connected to a wall outlet.
Figure 2:
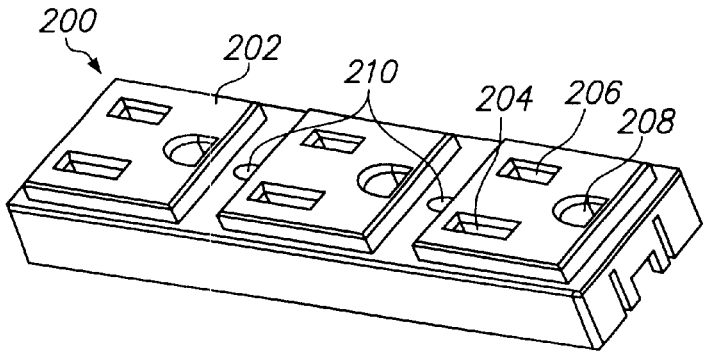
FIG. 2 is a top perspective view of a top portion of the housing of an electrical receptacle preferred embodiment in accordance with the present invention.

Referring now to FIG. 2, a top portion 200 of a housing of a triplex electrical receptacle embodiment of the present invention is illustrated in a top perspective view. The present invention may easily be adapted for an embodiment having any number of receptacles. The entire housing including the top portion 200 is preferably made of hardened or fire-retardant plastics. A top surface 202 of the top portion 200 has sets of apertures for three receptacles. Each set of apertures includes a neutral prong aperture 204, a hot prong aperture 206 and a ground prong aperture 208. The top surface 202 may also include screw apertures 210 for fastening portions of the housing together via the use of screws.

Figure 3:
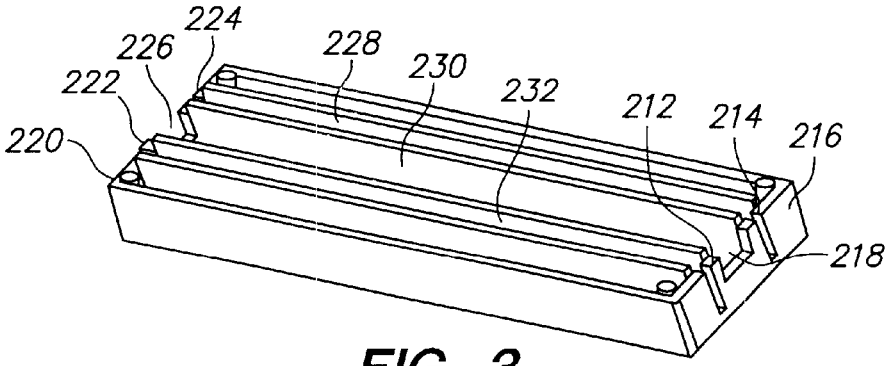
FIG. 3 is a bottom perspective view of the top portion of the housing of the electrical receptacle preferred embodiment in accordance with the present invention.

FIG. 3 illustrates a bottom perspective view of the top portion 200 of the housing of the electrical receptacle preferred embodiment in accordance with the present invention. Together with FIG. 2, two slits 212,214 are disposed on a first side surface 216 of the top portion 200 with a generally rectangular opening 218 disposed in between the two slits 212,214. Another pair of slits 222,224 and a generally rectangular opening 226 are found on a second side surface 220 that is directly opposite to the first side surface 216. The inside of the top portion 200 is preferably plastic-molded in a manner to have at least three elongated channels running lengthwise and parallel to each other. Namely, they include a neutral prong channel 228, a ground prong channel 230 and a hot prong channel 232. The neutral prong apertures 204 open into the neutral prong channel 228. Similarly, the hot prong apertures 206 and the ground prong apertures 208 open into the hot prong and ground prong channels 232,230 respectively.

Figure 4:
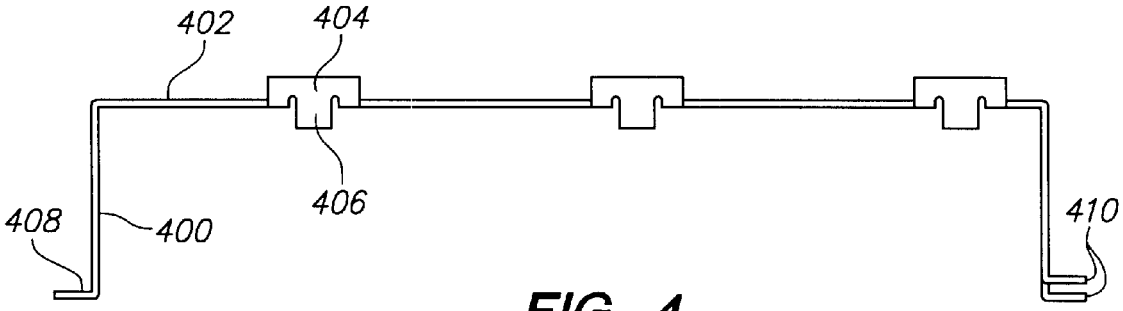
FIG. 4 is a side elevational view of a ground metal contact strip of the preferred embodiment in accordance with the present invention.
Figure 5:
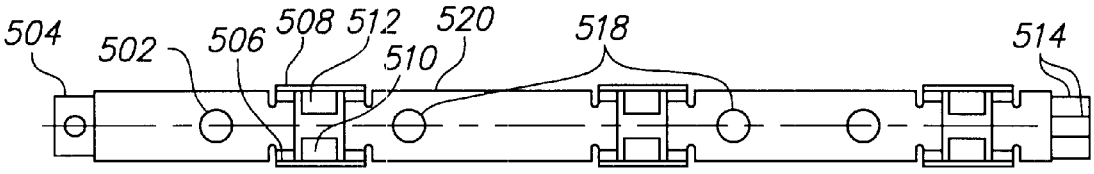
FIG. 5 is a top plan view of the ground metal contact strip of the preferred embodiment in accordance with the present invention.

FIG. 4 and FIG. 5 illustrate a ground metal contact strip for the present invention. FIG. 4 is a side elevational view whereas FIG. 5 is a top plan view of the strip. It is preferably being one integrated piece and made out of conducting metals. The ground metal contact strip includes an elongated portion 402,520, two bent portions 400 disposed at two ends of the elongated portion 402,520, a single ear 408,504 and a double ear 410,514 being contiguous to the two bent portions 400. There are also three pairs of flanges wherein each pair includes upper flanges 404,506,508 and lower flanges 406,512,510 both disposed along the sides of the elongated portion 402,520. In FIG. 5, the upper flanges 404,506,508 extend upward out of the page whereas the lower flanges 406,512,510 extend downward into the page gradually toward the center plane of the ground metal contact strip. The single ear 408,504 and the double ear 410,514 are generally perpendicular to the bent portions 400; the bent portions 400 are generally perpendicular to the elongated portion 402,520. In FIG. 5, the bent portions 400 may have any length but preferably at a length no longer than the depth of the receptacle housing. To provide a sense of direction, they 400 extend downward into the page in FIG. 5. Screw holes 518 are matched with the screw apertures 210 of the top portion 200 in FIG. 2 to receive fastening screws. Support holes 502 may be present to cooperate with the internal structures of the receptacle housing (not shown) to add support to the configuration. Also, a hole may be present on the single ear 408,504 for ease of soldering purposes.

FIG. 5 further illustrates an H-shaped hole formed by one pair of upper and its associated lower flanges. As a part of the preferred embodiment, the ground metal contact strip is placed length-wise into the ground prong channel 230 in a manner the upper flanges 404,506,508 extend toward the top surface 202 of the top portion 200. The H-shaped holes, as a result, are appropriately disposed to match the ground prong apertures 208, to receive ground prongs of power plugs and to allow the lower flanges 406,512,510 to make contact with the ground prongs. The length of the elongated portion 402,520 is slightly longer than the length of the top portion 200 so that the elongated portion 402,520 extends through the generally rectangular openings 218,226 of the top portion 200. As a result, the bent portions 400 are located outside of the top portion 200. The top portion 200 may be further configured to have internal structures (not shown) in the ground prong channel 230 to better guide and support the seating of the ground metal contact strip, for example, a couple of cylindrical structures for insertion into the support holes 502 for support purposes.

Figure 6:
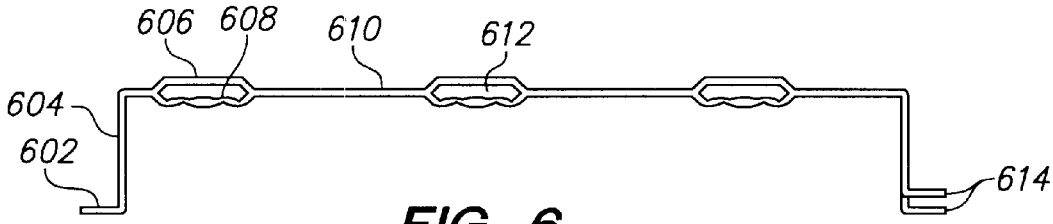
FIG. 6 is a side elevational view of a hot or neutral metal contact strip of the preferred embodiment in accordance with the present invention.
Figure 7:
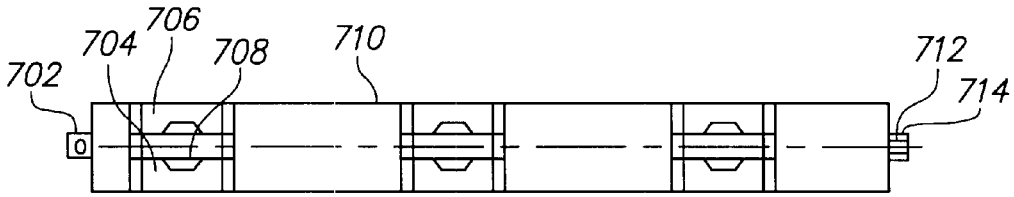
FIG. 7 is a top plan view of the hot or neutral metal contact strip of the preferred embodiment in accordance with the present invention.

FIG. 6 and FIG. 7 illustrate a hot or neutral metal contact strip for the present invention. FIG. 6 is a side elevational view whereas FIG. 7 is a top plan view of the strip. Again, like the ground metal contact strip, it is preferably being one integrated piece and made out of conducting metals. This metal contact strip includes an elongated portion 610,710, two bent portions 604 disposed at two ends of the elongated portion 610,710, a single ear 602,702 and a double ear 614,712,714 being contiguous to the two bent portions 604.

There are also three generally oval-shaped openings 612 wherein each opening is formed by a pair of side strips 606,704,706 bent upward and a central strip 608,706 bent downward. In FIG. 7, the two side strips 704,706 extend upward out of the page whereas the central strip 708 extend downward into the page. Similar to the ground metal contact strip, the single ear 602,702 and the double ear 614,712,714 are generally perpendicular to the bent portions 604, and the bent portions 604 are generally perpendicular to the elongated portion 610,710. In FIG. 7, the bent portions 604 may have any length but preferably at a length no longer than half the width of the receptacle housing. To provide a sense of direction, the bent portions 604 extend downward into the page in FIG. 7. Also, a hole may be present on the single ear 408,504 for ease of soldering purposes.

As a part of the preferred embodiment, two metal contact strips are placed length-wise, seated on their thin side, one into the neutral prong channel 228 and the other the hot prong channel 232. They are seated in the channels 228 and 232 in a manner that the generally oval-shaped openings 612 are appropriately disposed to match their respective prong apertures 204,206. The openings 612 are further adapted to receive neutral and hot prongs of power plugs and to allow the side strips 704,706 and the central strip 708 to make contact with the prongs. The length of the elongated portion 610,710 is preferably slightly longer than the length of the top portion 200 so that the elongated portion 610,710 extends through the slits 212,214,222,224 of the top portion 200.

Consequently, the bent portions 604 are located outside of the top portion 200. Also, the bent portions 604 of the neutral and hot metal contact strips when seated properly in their respective channels 228,232, are directed away from each other and toward the housing side surface that is closer to the respective channel 228,232. The top portion 200 may be further configured to have internal structures (not shown) in the neutral and hot prong channels 228,232 to better guide and support the seating of the metal contact strips as shown in FIG.6 and FIG. 7.

Once the neutral, hot and ground metal contact strips are suitably guided and properly seated into their respective channels, a bottom portion (not shown) of the receptacle may form the receptacle housing by fastening together with the top portion 200 via the use of screws. The bottom portion is appropriately configured so that the coupling with the top portion 200 would completely enclose the receptacle housing. In cases where the width of the elongated portions 610,710 is longer than the length of the slits 212,214,222, 224, then the bottom portion would also have slits appropriately adapted to allow the neutral and hot metal strips to extend freely out of the housing. As to the generally rectangular openings 218,226, the bottom portion would be appropriately adapted to completely enclose the housing but still allowing the ground metal contact strip to extend out of the receptacle housing.

Operatively, when more than one receptacle of the present invention are placed linearly with each other such as in the case of a power strip. The single ears of the neutral, hot and ground metal strips of one receptacle would be caught and held in between the double ears of their respective metal strips of the other receptacle. As a result, electrical coupling between the neutral, hot and ground terminals of these receptacles is without any use of wire. Preferably, the electrical coupling may be further fastened via the use of soldering for each single-double ear pair. In this manner, the need for the use of electrical wires for receptacle connection is greatly minimized or completely eliminated. Advantageously, it lowers the risks of electrical shorts and fires, and it decreases the size and costs of the power adapter products, such as power strips and extension boxes.

While the present invention has been described in terms of several preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What I claim is:

1. A receptacle apparatus having at least one electrical receptacle and further having a wireless coupling feature, the receptacle apparatus comprising:

a receptacle housing having a length, a top surface and also as its internal structures a neutral prong channel, a hot prong channel and a ground prong channel running parallel to each other along the length of the receptacle housing, said top surface further having receptacle apertures appropriately configured to receive neutral, hot and ground prongs of a power plug, the prongs being inserted through the receptacle apertures into their respective prong channels;

a neutral, hot and a ground metal contact strips associated with their respective prong channels each having an elongated portion, two bent portions disposed at both ends of the elongated portion and ears attaching to the bent portions, the elongated portion of each metal strip further being seated into its associated prong channel and adapted in a manner so that an inserted prong of the power plug being caught and making electrical contact with its associated metal strip;

the elongated portions of the metal contact strips extending through openings of the receptacle housing, the bent portions and the ears of the metal contact strips being disposed outside of the receptacle housing extending in directions generally away from each other;

the bent portions and the ears of the receptacle housing being configured so that in the case where one receptacle apparatus being placed linearly and in close proximity with another receptacle apparatus, the ears of the metal strips of one receptacle apparatus being paired and making electrical connection with the ears of their respective metal strips of the another receptacle apparatus.

2. The receptacle apparatus recited in claim 1 wherein the receptacle apparatus is a triplex receptacle.

3. The receptacle apparatus recited in claim 1 wherein the bent portions of the metal contact strips are generally perpendicular to their respective elongated portions, and the ears are generally perpendicular to their respective bent portions.

4. The receptacle apparatus recited in claim 1 wherein the ground metal contact strip has holes for screw insertion and position support.

5. The receptacle apparatus recited in claim 1 wherein the ears of the metal contact strips have holes for ease of fastening purposes.

6. The receptacle apparatus recited in claim 1 wherein the bent portions and the ears of the receptacle apparatus being configured so that in the case where the receptacle apparatus being placed linearly and in close proximity with the another receptacle apparatus, the ears of the metal strips of the one receptacle apparatus being caught and held by the ears of their respective metal strips of the another receptacle apparatus.

7. The receptacle apparatus recited in claim 1 wherein the openings through which the neutral and hot metal contact strips extend are slits.

8. The receptacle apparatus recited in claim 1 wherein the openings through which the ground metal contact strip extends are generally rectangular in shape.

9. A receptacle apparatus having at least one electrical receptacle and further having a wireless coupling feature, the receptacle apparatus comprising:

a receptacle housing having a length, a top surface and internal structures, said top surface further having receptacle apertures appropriately configured to receive neutral, hot and ground prongs of a power plug;

a neutral, hot and a ground metal contact strips each including an elongated portion disposed inside the receptacle housing and the elongated portion extending through openings of the receptacle housing, and two external portion disposed outside of the receptacle housing;

the external portions of the receptacle housing being configured so that in the case where one receptacle apparatus being placed linearly and in close proximity with another receptacle apparatus, the external portions of the metal strips of one receptacle apparatus being paired and making electrical connection with the external portions of their respective metal strips of the another receptacle apparatus.

10. The receptacle apparatus recited in claim 9 wherein the receptacle apparatus is a triplex receptacle.

11. The receptacle apparatus recited in claim 9 wherein the ground metal contact strip has holes for screw insertion and position support.

12. The receptacle apparatus recited in claim 9 wherein the external portions of the receptacle apparatus being configured so that in the case where the receptacle apparatus being placed linearly and in close proximity with the another receptacle apparatus, the external portions of the metal strips of the one receptacle apparatus being caught and held by the external portions of their respective metal strips of the another receptacle apparatus.

13. The receptacle apparatus recited in claim 9 wherein the openings through which the neutral and hot metal contact strips extend are slits.

14. The receptacle apparatus recited in claim 9 wherein the openings through which the ground metal contact strip extends are generally rectangular in shape.

15. A wirelessly-coupled receptacle system including two or more receptacle apparatus each apparatus having at least one electrical receptacle, said system wherein each receptacle apparatus comprising:

a receptacle housing having a length, a top surface and internal structures, said top surface further having receptacle apertures appropriately configured to receive neutral, hot and ground prongs of a power plug;

a neutral, hot and a ground metal contact strips each including an elongated portion disposed inside the receptacle housing and the elongated portion extending through openings of the receptacle housing, and two external portion disposed outside of the receptacle housing;

the external portions of the receptacle housing being configured so that in the case where one receptacle apparatus being placed linearly and in close proximity with another receptacle apparatus, the external portions of the metal strips of one receptacle apparatus being paired and making electrical connection with the external portions of their respective metal strips of the another receptacle apparatus.

* * * * *